United States Patent [19]

Aaroe

[11] 4,261,240

[45] Apr. 14, 1981

[54] OSCILLATING ELECTROMAGNETIC TRANSDUCER FOR GENERATING TREMOLO

[76] Inventor: Kenneth T. Aaroe, 2276 John Ct., Castro Valley, Calif. 94546

[21] Appl. No.: 92,538

[22] Filed: Nov. 8, 1979

[51] Int. Cl.[3] ..... G10H 3/00

[52] U.S. Cl. ..... 84/1.15; 84/1.16; 84/1.25

[58] Field of Search ..... 84/1.15, 1.14, 1.16, 84/1.25, DIG. 21

[56] References Cited

U.S. PATENT DOCUMENTS

| | | | |
|---|---|---|---|
| 2,512,015 | 6/1950 | Graveez | 84/1.25 |
| 2,896,491 | 7/1959 | Lover | 84/1.15 |
| 3,252,368 | 5/1966 | Jeffrey et al. | 84/1.16 |
| 3,290,424 | 12/1966 | Fender | 84/1.16 |
| 3,499,971 | 3/1970 | Ohno | 84/1.25 |
| 3,911,777 | 10/1975 | Rendell | 84/1.16 |

FOREIGN PATENT DOCUMENTS

| | | | |
|---|---|---|---|
| 664987 | 5/1979 | U.S.S.R. | 84/1.15 |

OTHER PUBLICATIONS

Brice Ward, Electronic Music Circuit Guidebook, 1975, p. 15.

*Primary Examiner*—Stanley J. Witkowski
*Assistant Examiner*—Forester W. Isen
*Attorney, Agent, or Firm*—Linval B. Castle

[57] ABSTRACT

An electromagnetic pickup for stringed instruments such as a guitar includes a pickup coil that is mechanically oscillated at variable frequencies in the field of the magnetically polarized instrument strings for producing an effective tremolo output signal.

9 Claims, 13 Drawing Figures

FIG. 1.
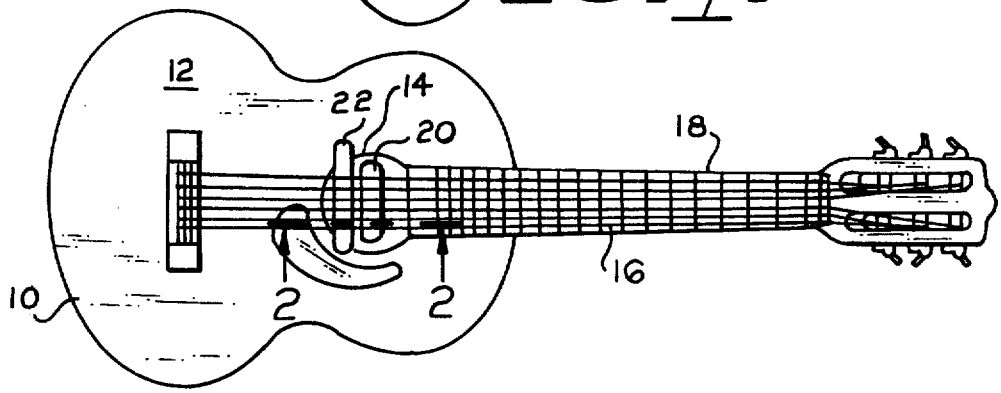
FIG. 2.
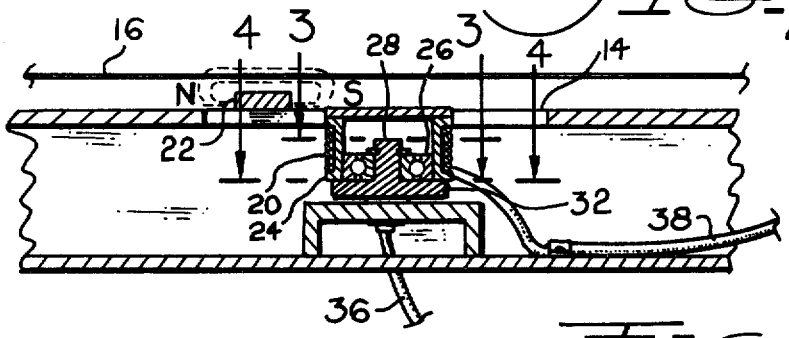
FIG. 4.
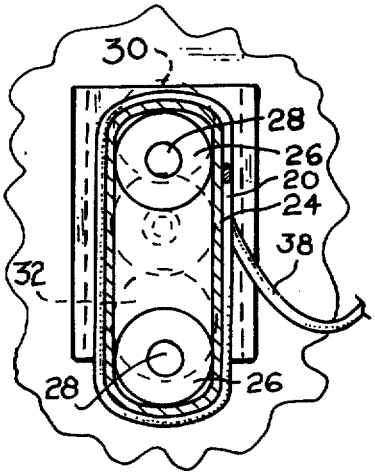
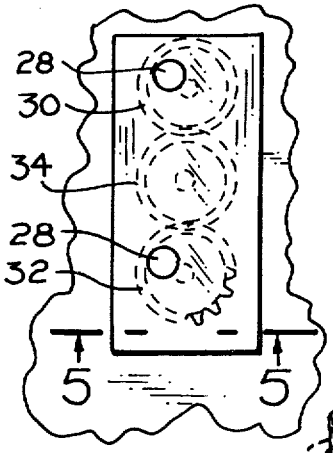
FIG. 3.
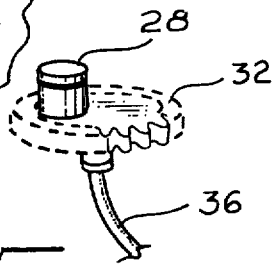
FIG. 5.

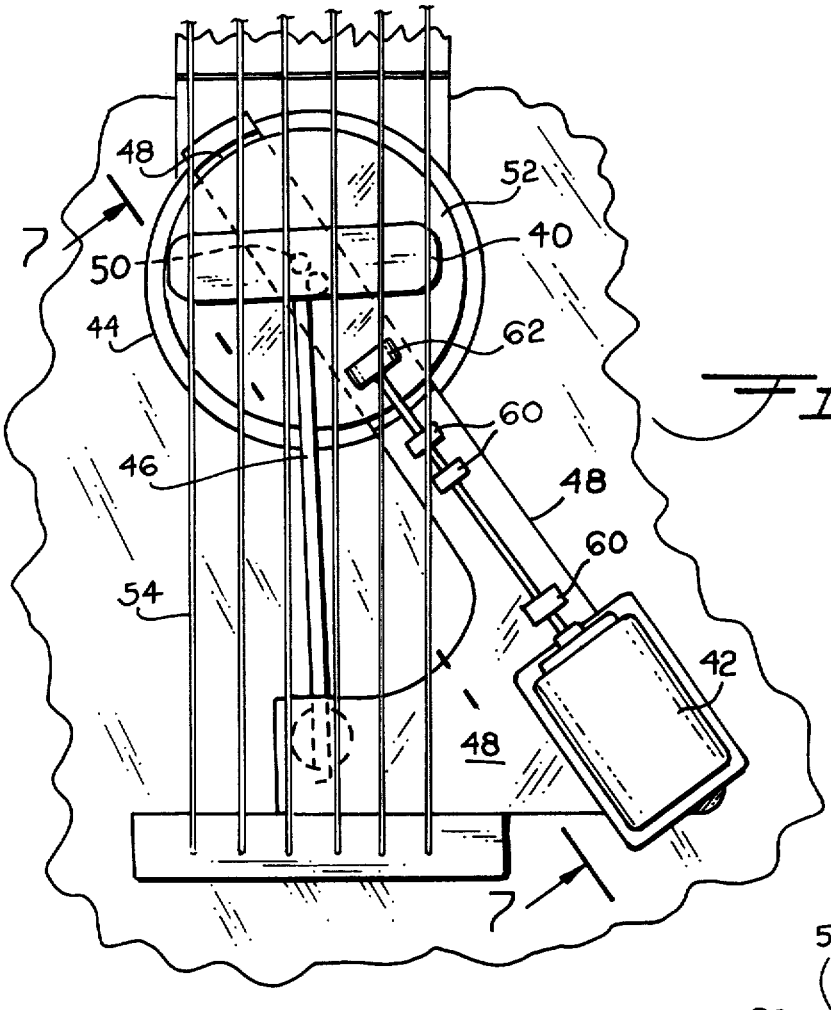
FIG. 6.
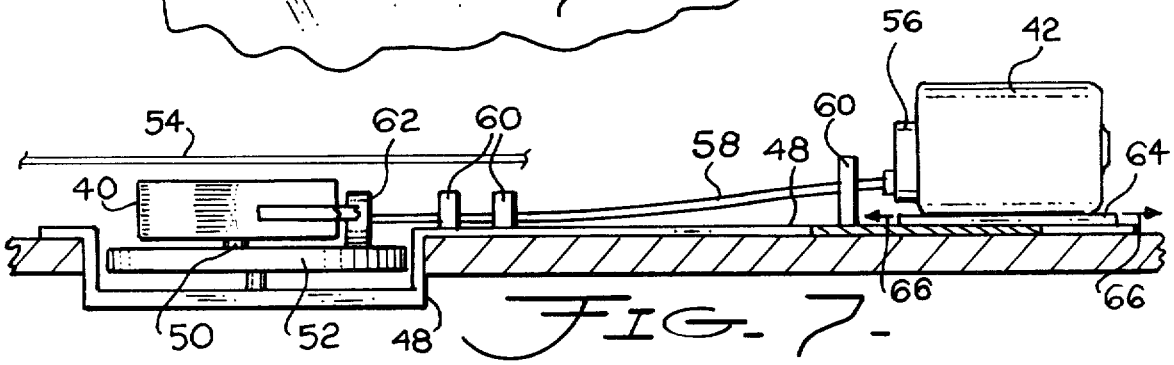
FIG. 7.
FIG. 8.
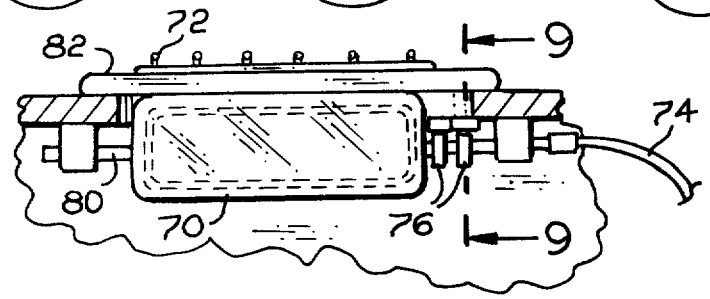
FIG. 9.
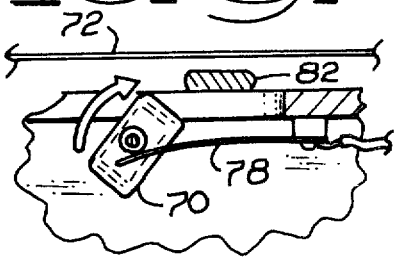

OSCILLATING ELECTROMAGNETIC TRANSDUCER FOR GENERATING TREMOLO

BRIEF SUMMARY OF THE INVENTION

Electromagnetic transducers or pickups for use with stringed instruments such as guitars or the like generally employ an associated bar magnet lying adjacent the magnetizable strings of the instrument for producing magnetic poles at two closely spaced nodes along each string, as described in U.S. Pat. No. 2,896,491 to S. E. Lover. The pickup coil is then positioned beneath and closely adjacent the magnetizable strings with one leg of the coil in the magnetic flux path between the poles so that any vibration of the instrument's string will correspondingly vibrate the magnetic flux circuit to induce a signal into the pickup coil.

The pickup described and claimed herein is of the type described above but is mechanically oscillated or vibrated at any desired frequency within the magnetic field established between the poles to produce a tremolo output signal.

Vibrato, which may be generally defined as the slight and rapid pitch variations in a musical instrument and which is similar to vocal tremelo, is generally produced in stringed instruments by rapidly rolling the fingers over the instrument's neck frets to correspondingly vary the length of the string and hence its vibration frequency. Electronically amplified instruments can achieve a vibrato effect by incorporating electronic circuitry that can rapidly and slightly vary the signal intensity at some predetermined rate. Although such level variations do not produce vibrato in the true sense, a pleasing tremolo effect is produced that often sounds substantially the same as the vibrato produced by pitch variations.

By mechanically oscillating or vibrating the electromagnetic pickup within the magnetic field on the magnetizable strings, the pickup of the invention achieves a tremolo effect by varying the signal intensity. There is a small but nearly undiscernible component of pitch variation resulting from doppler effect of the moving pickup coil; however, this vibrato is not readily detectable when compared with the tremolo effect produced by signal level variations.

Briefly described, the invention includes a pickup coil that is positioned beneath the magnetizable strings of a musical instrument, such as a guitar, and in the flux circuit between the magnetic poles established in each string by an associated permanent magnet. The entire pickup coil structure is coupled to a motor driven mechanism that physically vibrates or oscillates the coil within the flux circuit at a desired frequency to thereby vary the magnetically induced signal voltage and to produce a tremolo effect in the amplified output signal.

DESCRIPTION OF THE DRAWINGS

In the drawings which illustrate several preferred embodiments of the invention:

FIG. 1 is a plan view of a typical acoustic guitar illustrating the location of the pickup coil and associated magnet;

FIG. 2 is a sectional elevation view taken along the lines 2—2 of FIG. 1;

FIG. 3 is a sectional plan view of a portion of the pickup coil and oscillating mechanism taken along the lines 3—3 of FIG. 2;

FIG. 4 is a sectional plan view taken along the lines 4—4 of FIG. 2;

FIG. 5 is a perspective view illustrating the eccentric mechanism taken along the lines 5—5 of FIG. 4;

FIG. 6 is a sectional plan view of a second embodiment of the invention illustrating a variable speed motor drive for oscillating the pickup coil;

FIG. 7 is a sectional elevation view taken along the lines 7—7 of FIG. 6;

FIG. 8 is a sectional elevation view of a third embodiment of the invention in which the pickup coil is rotated beneath the instrument strings;

FIG. 9 is a side elevation sectional view taken along the lines 9—9 of FIG. 8;

DETAILED DESCRIPTION

Figure 10:
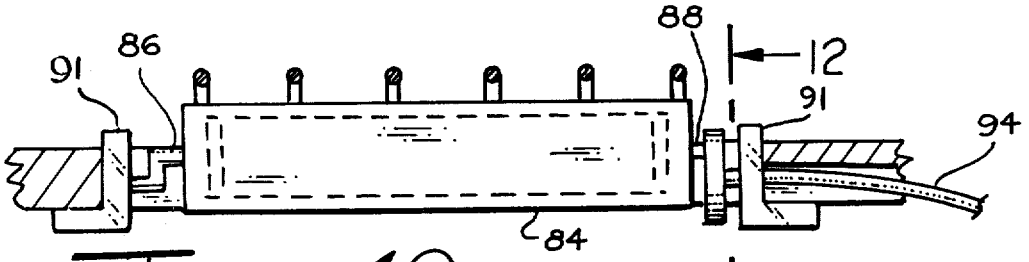
FIG. 10 is a sectional elevation view illustrating a fourth embodiment of the invention and means for oscillating the coil beneath the magnetized strings.

FIG. 1 is a plan view illustrating a typical acoustic guitar 10 having a top or soundboard 12 with an aperture 14 centrally located under strings 18 and aligned with the neck 19. Centrally positioned in the aperture 14 is an elongated pickup coil 20, and adjacent the coil is a bar magnet 22.

As best illustrated in the sectional elevation view of FIG. 2, bar magnet 22 is magnetized so that its north-south poles lie on an axis parallel with the guitar strings 18. The guitar strings 18 are conventional parallel and coplanar steel strings and are magnetizable so that the flux field between the poles of the bar magnet 22 will closely follow along the steel strings 18 and will create corresponding magnetic poles along the strings 18. That is, the south pole of magnet 22 will create a corresponding north pole in the adjacent area of the strings 18 and the north pole of the magnet 22 will create a south magnetic pole in the adjacent area on the strings 18. In most cases, after the string has been magnetized by the presence of the bar magnet 22, the bar magnet may be removed and the pickup coil 20 will continue to function properly for a long period.

FIG. 2 illustrates the pickup coil 20 adjacent the bar magnet 22 generally positioned so that one side or leg of the coil is within the flux field generated by the magnet and substantially perpendicular to the lines of flux in the flux path. Both sides of coil 20 may be in the flux path, but to prevent cancellation of the induced signal voltage, one leg of the coil must be in an area of higher flux density. Coil 20 is wound upon an elongated hollow bobbin 24 preferably composed of a plastic material. The internal walls of bobbin 24 support, at each end, the outer ring of a ball bearing assembly 26 as best illustrated in the sectional plan view of FIG. 3. The inner ring of ball bearings 26 are coupled to studs 28 extending from the upper surface of spur gears 30 and 32. As best illustrated in FIG. 4, the studs 28 are offset from the centers of gears 30 and 32 so that rotation of gears 30 and 32 by a centrally positioned idler gear 34, that engages both the spur gears 30 and 32, will cause the studs 28 to produce an eccentric motion to the pickup coil 20.

Rotation of the gears 30, 32 and 34 is accomplished by connecting a flexible rotatable drive shaft 36 to any one of the gears, such as the gear 32 as illustrated in FIG. 5. The drive cable 36 may be coupled to a small variable speed D.C. motor that is preferably packaged along with its battery pack or converter in a housing that may be attached to the belt of the musician.

As the drive shaft 36 rotates the gear 32, the gear drives the idler 34 and the corresponding spur gear 30 so that the eccentric studs 28 cause the pickup coil 20 to oscillate within the magnetic flux field established by the magnet 22. When one of the strings 18 is vibrated at its resonant frequency, the flux field correspondingly vibrates so that the coil 20, cutting this flux field, generates an output signal voltage which is carried by the conductors 38 to external amplifying means. As the coil 20 mechanically oscillates within the flux field, an additional modulation of the output signal is produced at a frequency dependent upon the rotational speed of the external D.C. motor and the oscillation frequency of the coil 20 to produce in the output conductors 38 a tremolo signal containing a small vibrato component. As previously mentioned, the bar magnet 22 may, if desired, be removed and the residual magnetic poles in the strings 18 will produce a flux field sufficient to produce a strong output signal.

FIGS. 6 and 7 illustrate an embodiment of the invention in which the pickup coil 40 is oscillated by a direct drive system including an A.C. motor 42 which is movable to vary the oscillation frequency of the coil 40. In the plan view of FIG. 6, pickup coil 40 is positioned in the aperture 44 of a guitar and is held in position by an elongated semi-rigid rod or bar 46 connected to the center of the coil bobbin and perpendicular to its longitudinal axis. The opposite end of bar 46 is slidably coupled into a mating hole in a frame member 48, which is preferably a plastic or aluminum member that also carries the motor 42 and which includes an insert section that fits into the guitar recess 44 as best illustrated in FIG. 7. The rod 46 is preferably square or is provided with a flat portion as it enters the frame 48 to prevent rotation of the rod 46 and consequent rotation of the coil 40 around the axis of the rod.

The coil 40 is wound on an elongated bobbin having a lower surface containing a centrally located hole for receiving a stud 50 extending from the top surface of a rotatable disc 52 which is journalled in the frame member 48 as best illustrated in FIG. 7. Stud 50 is mounted off the center of disc 52 so that rotation of the disc will produce the eccentric movement of the pickup coil 40 in the magnetic flux field (not shown) in the steel guitar strings 54.

Disc 52 is rotated by motor 42 which is preferably an A.C. motor having a reduction gear box 56, the output of which drives a resilient, semi-flexible shaft 58 through suitable bushings 60. Coupled to the end of shaft 58 is a friction gear 62 comprising a wheel having a rubberized periphery that engages the surface of the disc 52. Motor 42 is mounted to a movable pad 64 which may be moved longitudinally in the direction of the arrows 66 so that the friction wheel 62 may be correspondingly moved along the radius of the disc 52 to thereby vary the rotational speed of the disc 52 and the oscillation frequency of the pickup coil 40. In the preferred embodiment, the motor pad 64 contains slots immediately beneath the motor (not shown) that are parallel with the longitudinal movement of the motor 42. Flat headed rivets rigidly connected to the frame member 48 extend through the slots to retain the motor pad 64 and its motor 42 and to permit the motor to be manually adjusted in the direction of the arrows 66. Very small power output is required from the motor 42 and its gear reducer 56; therefore, motor 42 may be very small so that it will not seriously interfere with the operation of the guitar and may be very rapidly and conveniently moved to alter the rotational speed of disc 52 and the corresponding oscillation of the pickup coil 40 mounted to the end of rod 46.

FIGS. 8 and 9 illustrate another embodiment of the invention and illustrate a coil 70 which is rotated around its longitudinal axis beneath guitar strings 72 by a rotatable drive shaft 74 coupled to a variable speed motor source. In this embodiment, the output signal must be connected through slip rings 76 which are contacted with resilient conductors 78 as best illustrated in FIG. 9. In this embodiment, the coil 70 is provided with a central longitudinal shaft 80 suitably journalled to bearings connected to the guitar body so that rotation of the input shaft 74 will drive shaft 80 and the coil 70 in the magnetic field produced by the associated bar magnet 82.

Figure 11:
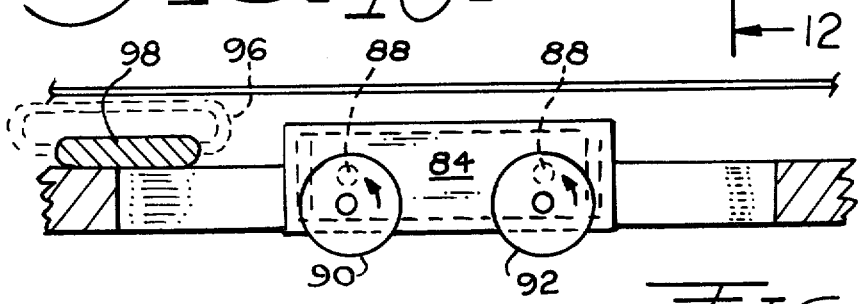
FIG. 11 is a side elevation view taken along the lines 11—11 of FIG. 10.

Another method of oscillating the pickup coil within the magnetic field is illustrated in FIGS. 10 and 11. In this embodiment the coil 84 is wound upon an elongated rectangular bobbin having a pair of holes in each end that receive studs 86 and 88. The studs 86 are formed of a small crank element coupled to a housing member attached to the guitar body. Studs 88 are eccentric studs mounted in a pair of rotatable wheels 90 and 92 having their central axis connected to the frame member at the opposite side of the crank stud 86. The axes of rotation of discs 90 and 92 are parallel with the surface of the guitar body and the studs 88 in the discs' surfaces are similarly aligned. A flexible rotatable shaft 94 is connected to either one of the wheels 90 or 92 to provide rotation thereto and a corresponding eccentric oscillation of the pickup coil 84 within the magnetic field 96 produced by the bar magnet 98.

Figure 12:
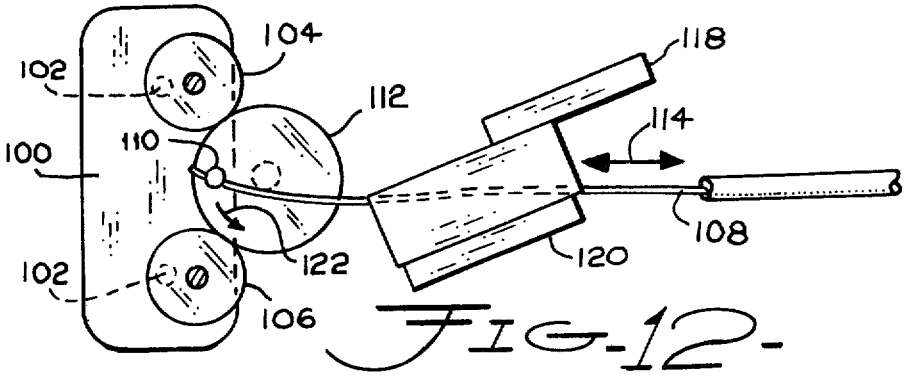
FIG. 12 is a simplified plan view of a fifth embodiment illustrating means for oscillating the pickup coil.
Figure 13:
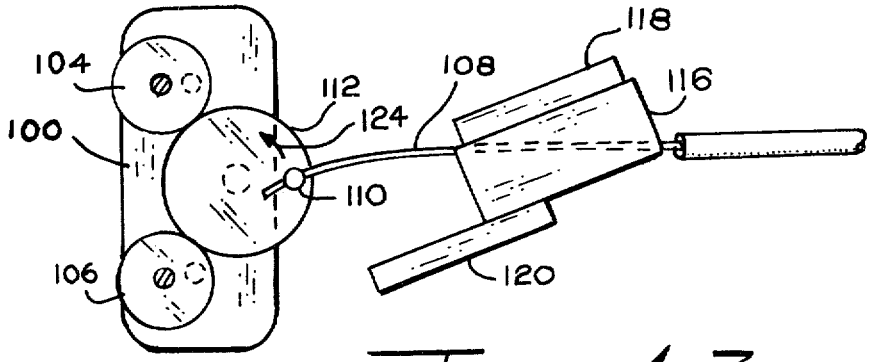
FIG. 13 is a plan view similar to that illustrated in FIG. 12 but showing the drive mechanism in a different position.

FIGS. 12 and 13 illustrate still another mechanism for providing rotation or oscillation of the pickup coil within the magnetic field along the strings of the instrument. The oscillation mechanism of FIGS. 12 and 13 is closely related to the oscillation mechanism described in connection with FIGS. 3 and 4 in that the pickup coil 100 is oscillated by studs 102 eccentrically mounted in the surface of rotatable gears 104 and 106. In this embodiment, however, rotational movement of gears 104 and 106 is provided by a resilient push-pull shaft or cable 108 which is preferably coupled to a crank member (not shown) rotated by a suitable variable speed motor. The end of the cable 108 is connected to a stud 110 extending from the top surface of a rotatable drive gear 112. Stud 110 is offset from the center of the gear 112 so that the push-pull action of the cable 108 as indicated by the arrow 114 will cause rotation of the gear 112 and corresponding rotation of the gears 104 and 106.

In order to prevent a failure of the cable 108 to rotate the gear 112 because of the possibility that the stud 110 is at "dead-center", a portion of the shaft adjacent the gear 112 is rigidly coupled to a slidable rectangular block 116 which is preferably made of plastic and which is restricted to slide at an angle of approximately 30° to the axis of the cable 108 by guide blocks 118 and 120 which are rigidly connected to a frame member coupled to the guitar body (not shown). As illustrated in FIG.

12, the cable 108 is fully extended and the block 116 is at its lower position so that the section of the cable 108 between the sliding block 116 and the pin is positioned to rotate the gear 112 past its dead-center position as indicated by the arrow 122. As the cable 108 is then retracted, it will pull the gear 112 to its second dead-center position as illustrated in FIG. 13. However, the sliding block 116 is now in its uppermost position to cause the section of the cable 108 between block 116 and the gear 112 to further rotate the gear 112 past the dead-center position and in a direction as indicated by the arrow 124. Thus, the in-and-out or push-pull drive of the shaft 108 will always spring the drive gear 112 past its dead-center position so that it may be easily rotated to drive the gears 104 and 106 to oscillate the coil 100 in the magnetic field such as that illustrated in FIGS. 1 and 2.

Having thus described my invention and several embodiments thereof, what is claimed is:

1. A tremolo generating electromagnetic pickup for sensing vibrations in combination with magnetizable strings of a musical instrument, said magnetizable string generating a magnetic flux path, said pickup comprising:

a pickup coil positioned in said magnetic flux path, one leg of said coil being aligned substantially perpendicular to the lines of flux in said flux path to cut said lines of flux upon vibration of said string; and means for physically vibrating said coil in said magnetic flux path at a vibration frequency proportional to the desired tremolo frequency.

2. The pickup claimed in claim 1 wherein said pickup coil closely underlies a plurality of magnetizable strings in a musical instrument, said strings being substantially parallel and having longitudinal axes that are substantially coplanar.

3. The pickup claimed in claim 2 wherein said pickup coil is wound around an elongated bobbin having a bottom surface substantially parallel with said coplanar strings, and wherein said means includes a motor driven gear train having a pair of identical spur gears interconnected by an idler gear, each of said spur gears being coplanar and having in one surface an eccentrically positioned stud that engages a mating hole in the bottom surface of said bobbin for oscillating said bobbin and said pickup coil in a plane parallel with said coplanar strings.

4. The pickup claimed in claim 3 wherein said gear train is rotated by a flexible motor driven rotatable shaft coupled to the axis of one of said gears in said gear train.

5. The pickup claimed in claim 3 wherein said gear train is rotated by a motor driven push-pull shaft, one end of which is connected to a stud extending from the surface of said idler gear.

6. The pickup claimed in claim 5 wherein said push-pull shaft is further connected to a rectangular sliding block adjacent said idler gear and slidable between first and second guide blocks mounted to a stationary member, said guide blocks being positioned to force said sliding blocks to slide at an angle to a position whereby said shaft when fully extended and retracted will spring said idler gear past its dead-center position.

7. The pickup claimed in claim 2 wherein said pickup coil is wound around an elongated bobbin having a bottom surface substantially parallel with said coplanar strings, said bobbin being supported on the first end of an elongated rod member, the second end of said member being slidably coupled to a stationary portion of said musical instrument, and wherein said means includes a rotatable disc having a flat top surface parallel with the bottom surface of said bobbin, an eccentrically positioned stud extending from said disc top surface and mating with a centrally positioned hole in said bobbin bottom surface, a motor, and a variable speed drive comprising a rotatable drive shaft coupled between said motor and said disc top surface, a friction gear coupled to said drive shaft and engaging said disc top surface, and means for moving said friction gear along the radius of said disc top surface to vary the rotational speed thereof and the oscillation frequency of said pickup coil.

8. The pickup claimed in claim 2 wherein said pickup coil is wound around an elongated bobbin mounted to a rotatable shaft on the longitudinal axis of said bobbin, the terminals of said pickup coil being coupled to a pair of slip rings coaxial with said shaft and in contact with a corresponding pair of brush elements coupled to output conductors, and said means includes a flexible motor driven rotatable cable coupled to said rotatable shaft.

9. The pickup claimed in claim 2 wherein said pickup coil is wound around an elongated bobbin having a bottom surface substantially parallel with said coplanar strings, and wherein said means includes first and second gears located at the first end of said bobbin and having rotating gear shafts parallel with the longitudinal axis of said bobbin, said gears having studs eccentrically positioned in the gear surfaces facing said bobbin's first end and engaging mating holes in said first end whereby rotation of said gears by a motor rotated flexible cable coupled to the shaft of one of said gears will oscillate said bobbin in a path in which the bobbin bottom surface remains parallel with said coplanar strings.

* * * * *